United States Patent [19]

Zerillo

[11] Patent Number: 4,958,112

[45] Date of Patent: Sep. 18, 1990

[54] DRAPERY ACTUATOR OPERATED BY LAMP TIMER AND HAND-HELD WIRELESS REMOTE CONTROL

[76] Inventor: Michael A. Zerillo, 4143 Elizabeth La., Annandale, Va. 22003

[21] Appl. No.: 413,283

[22] Filed: Sep. 27, 1989

[51] Int. Cl.[5] ..... A47H 5/032

[52] U.S. Cl. ..... 318/280; 318/16; 318/256; 318/467; 318/468; 160/331; 49/349

[58] Field of Search ..... 318/16, 255, 256, 264, 318/265, 266, 280, 445, 466, 467, 468; 307/132 R; 160/131, 136, 138, 149, 166.1, 310, 311, 330, 331, 335, 336, 1, 2, 7; 49/139, 279, 280, 340, 349, 357, 360

[56] References Cited

U.S. PATENT DOCUMENTS

| | | | |
|---|---|---|---|
| 3,117,767 | 1/1964 | McLean et al. | 160/331 X |
| 3,153,942 | 10/1964 | Staak | 160/331 X |
| 3,269,454 | 8/1966 | Gill et al. | 160/331 |
| 3,403,474 | 10/1968 | Spasoff | 49/139 X |
| 3,561,520 | 2/1971 | Gill | 160/331 |
| 3,646,985 | 3/1972 | Klann | 160/5 X |
| 4,173,721 | 11/1979 | Louis | 160/2 X |
| 4,471,275 | 9/1984 | Comeau | 318/286 |
| 4,610,294 | 9/1986 | Anesi et al. | 160/331 |
| 4,819,708 | 4/1989 | Onosato et al. | 160/331 |
| 4,856,574 | 8/1989 | Minami et al. | 160/166.1 X |

*Primary Examiner*—Bentsu Ro

[57] ABSTRACT

A mechanism which engages the pull-cord that opens and closes draperies, whereby the mechanism possesses a unique motor control for its automatic operation by a lamp timer (any of the commercially available clock actuated switches which are used in many households to automatically turn lamps ON and OFF at desired times). An alternate control system whereby the mechanism may be operated by a wireless remote control system in concert with the lamp timer. An adjustable means whereby the draperies may be opened and closed to any of two independently selectable positions within the means of the drapery rod. An easy to install mounting bracket with an easy to adjust tension means for driving engagement and hand-operation of the pull-cord.

21 Claims, 6 Drawing Sheets

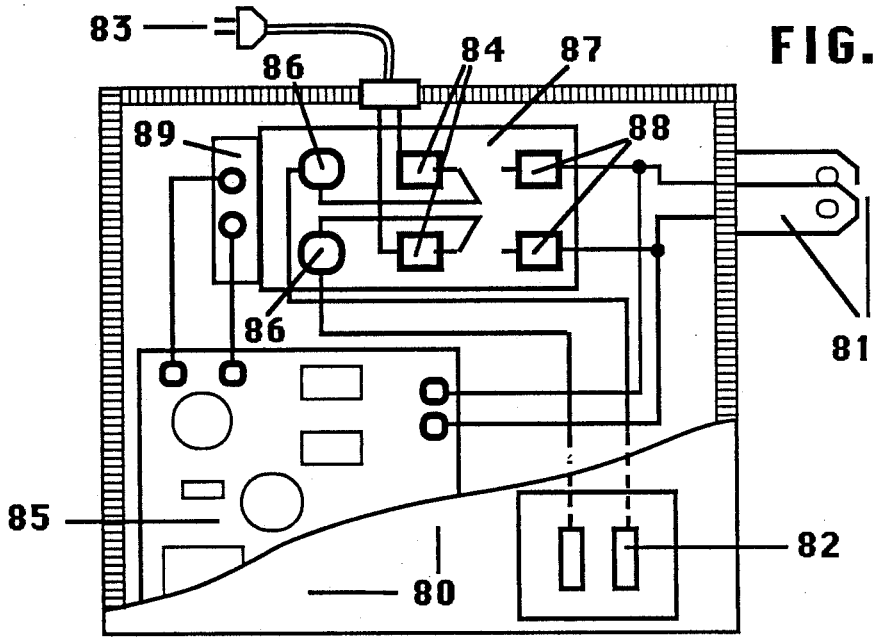
FIG. 6
FIG. 7
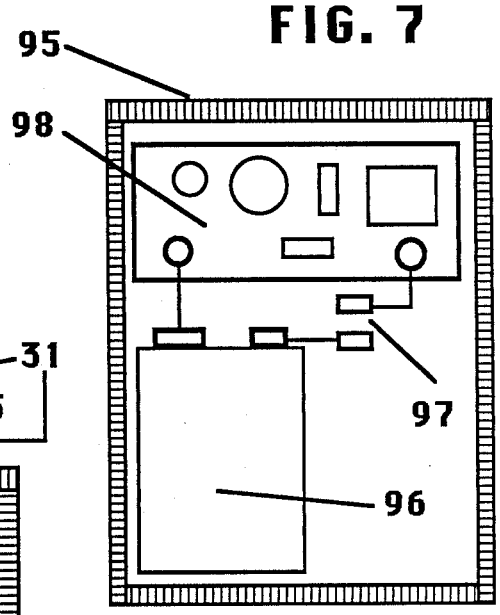
FIG. 8
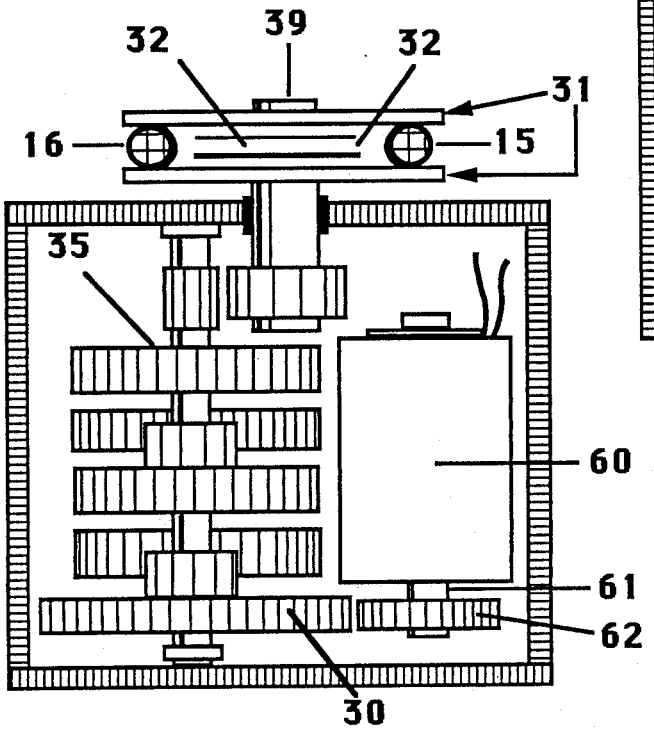

41
60
45
43
43
47
47
44
44
48
48
POLES
POLES
42
46
65
51
40
66
52
+
-
70
71
72
100

41
60
45
43
43
47
47
44
44
48
48
POLES
POLES
42
46
65
51
40
66
52
+
-
70
71
72
100

DRAPERY ACTUATOR OPERATED BY LAMP TIMER AND HAND-HELD WIRELESS REMOTE CONTROL

BACKGROUND

Various mechanism have been invented to open and close draperies. Some are operated by a master ON/-OFF switch but lack the means for true automatic operation, while others incorporate two timed switches to control opening and closing sequences but are expensive and not always reliable in repetitive operations. Patents disclosing such devices include U.S. Pat. Nos. 3,269,454 to Gill, 4,610,294 to Anesi, and others.

However, none of the drapery actuators known in the art have the essential motor control means that provides for their complete and automatic operation when plugged-in to an ordinary lamp timer. Timers like these are used in many households to turn lamps and applicances ON and OFF at desired times of the day, they are abundant in their use, and are readily available for purchase. Examples include the Intermatic Incorporated Model SB711C; the AMF Corporation Paragon Model C104-00; the Tandy Corporation Radio Shack Controller Timer with separate Appliance Module Catalog Numbers 61-2670 and 61-2681 respectively; the Stanley Corporation Lamp Remote Control with separate Lamp Module Numbers 370-2682 and 370-2474 respectively, and a large variety of other clock actuated switches. Herein, these devices shall be referred to as lamp timers, and clock actuated switch means.

Further, none of the drapery actuators known in the art provides a remote control system that may be used as the only control device, or may alternately be connected in tandem with virtually any lamp timer, and thereby provide an integrated control system whereby the drapery actuator may be operated by wireless remote control and by a lamp timer.

SUMMARY OF THE INVENTION

A principal object of the present invention is to provide a useful and improved drapery actuator which will open and close draperies and vertical blinds automatically at virtually any desired time of the day.

An additional object of the present invention is to provide the improved drapery actuator with a simple motor and control means that permits it to be operated by virtually any lamp timer, and thereby facilitate the use of lamp timers that already exist in many households, as well as those which are readily available for purchase.

An additional object of the present invention is to provide a remote control system that will operate the improved drapery actuator from a distance with a hand-held wireless remote control transmitter.

An additional object of the present invention is to provide the remote control system with a means to integrate its operating functions with the operating functions of the lamp timer so that a single improved drapery actuator may be operated by the lamp timer and the remote control system.

An additional object of the present invention is to provide a means to operate the improved drapery actuator by plugging it into an electrical wall outlet whereby the circuit to the wall outlet is controlled by a wall switch that can switch electricity ON and OFF.

An additional object of the present invention is to provide an improved drapery actuator with a means to easily set the distance by which it will open and close the drapery members, including the ability to establish two position settings for virtually any desired position within the means of the drapery rod, and the ability to adjust each setting independent of the other.

An additional object of the present invention is to provide an improved drapery actuator with a drive mechanism which can advance drapery pull-cords made of fiber, plastic, and other standard drapery pull-cord materials, as well as the ball-chain type made of metal or plastic.

An additional object of the present invention is to provide an improved drapery actuator with an easy to adjust tension means that maintains forcible engagement of the drapery pull-cord within the drive means of the drapery actuator.

An additional object of the present invention is to provide an improved drapery actuator with a tension means which can be easily disengaged so that the drapery can be opened and closed by traditional hand operation of the pull-cord at desired times, and during electrical power outages.

An additional object of the present invention is to provide an improved drapery actuator with a simple mounting system that facilitates easy installation and removal, resulting in a device which may be relocated to virtually any drapery and similar closure system.

DESCRIPTION OF DRAWINGS

FIG. 6 illustrates the remote control system receiver/controller unit of the invention, its outlet and plug means, a cut-away view showing its switch control and switch circuit means, and a receiver means which may be a type of radio frequency receivers already known in the art that is responsive to a signal from a companion transmitter.

FIG. 7 illustrates the remote control system hand-held wireless transmitter of the invention with a cut-away view showing its battery, switch and circuit means, and a transmitter means which may be a type of radio frequency transmitter already known in the art that can transmit a signal over some distance to a companion receiver.

FIG. 8 is a view looking down from the top illustrating the drive means of the invention with the drapery pull-cord fully engaged, and shows the drive means engaged with the geartrain and the geartrain affixed to the output shaft of the reversible motor.

DESCRIPTION OF THE PREFERRED EMBODIMENT

Figure 1:
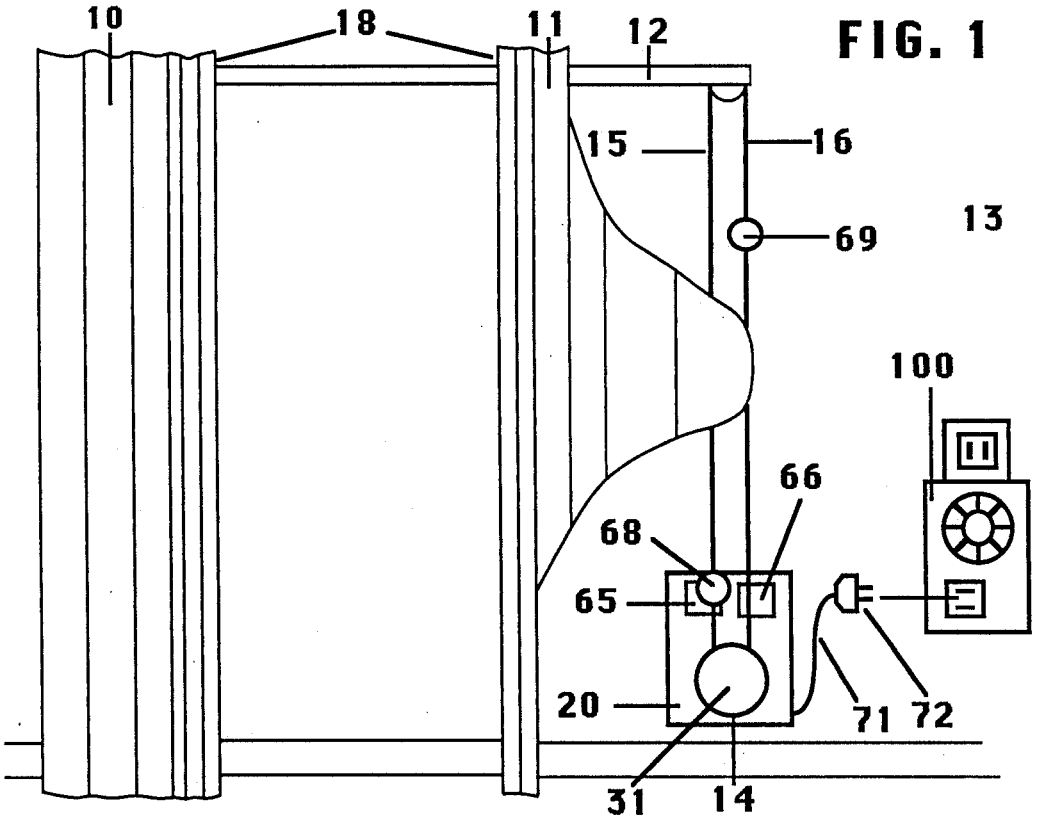
FIGS. 1 and 2 illustrate the invention connected in an alternate configuration whereby the lamp timer is used as the only control means of the invention. Also shown is the invention engaged with the pull-cord of the draperies, and examples of how the actuators affixed to the pull-cord are repositioned by the invention when it opens and closes the draperies, and how the limit switches of the motor control are actuated when the draperies are located at a selectable closure position setting.
Figure 2:
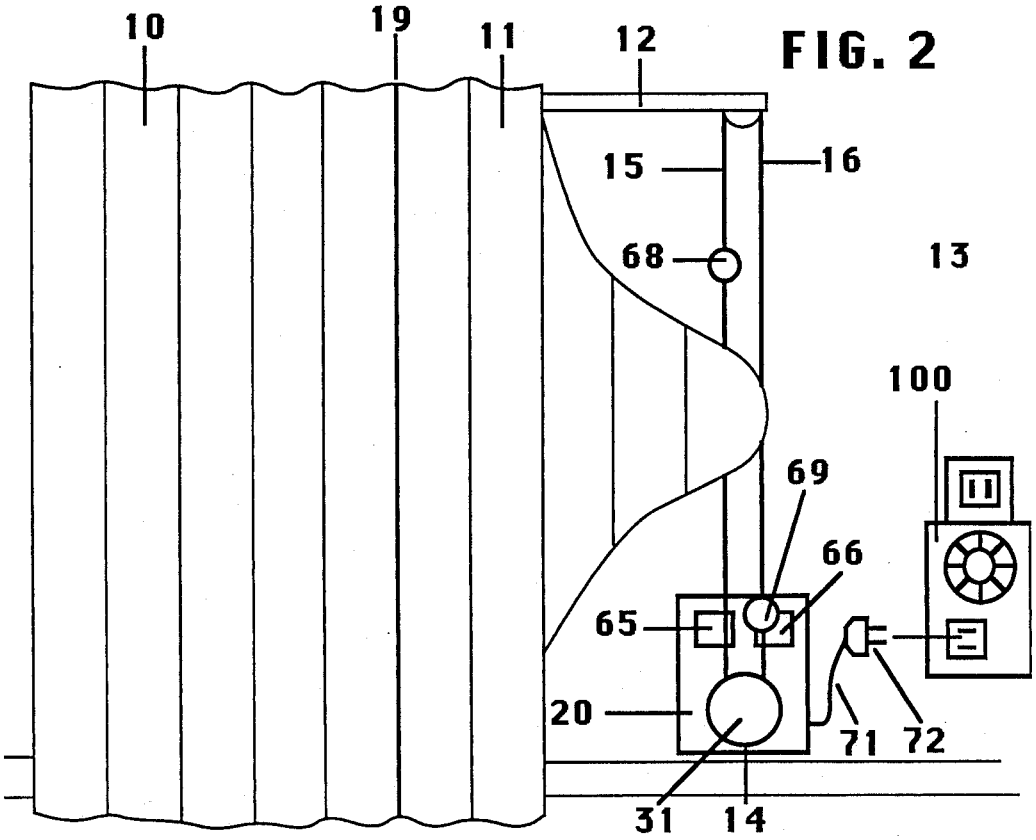

A set of draperies 10 and 11, as illustrated in FIG. 1 and 2, are mounted in a usual manner on a drapery rod 12 attached to a wall 13. A pull-cord is affixed to the means provided by drapery rod 12, and thereby to draperies 10 and 11, in such a manner as to form a bight 14 with vertical and parallel reaches 15 and 16. Consistent with the normal operation of this closure system, a downward pull on one of the reaches opens the draperies partly or completely to a closure position within the means of drapery rod 12, and thereafter a downward pull on the opposite reach closes the draperies partly or completely to a closure position within the means of drapery rod 12.

A mechanism 20 is provided to automatically open and close draperies 10 and 11 to closure positions within the means of drapery rod 12. Mechanism 20 consists of main housing 21, direct current (DC) electric reversible motor 60, gear-train 35, drive means 31, motor control 40 with limit switches 65 and 66, limit switch actuators 68 and 69, direct current (DC) electric power supply 70, electrical cable 71 with plug 72 to connect the means of mechanism 20 to a means of electricity, and mounting bracket 110 with mounting screws 119.

Mechanism 20 also includes the following remote control system components: receiver/controller unit 80 and hand-held wireless remote control transmitter 95.

Not provided with mechanism 20 is the commonly used and abundantly available lamp timer 100. This device plugs into a standard alternating current (AC) electrical wall outlet and has a 24-hour clock mechanism with a switch and actuator means to automatically cause electricity to be switched ON and OFF to its outlet at desired times of the day. Frequently, this device includes multiple adjustable actuators so that one or more ON and OFF switch cycles may be set for a 24-hour period. Lamp timer 100 may also have a manual means to actuate its switch ON and OFF. Thereby, when the switch means of lamp timer 100 is ON, electricity is made available to its outlet and thereby to any device plugged-in to it. And, when the switch means of lamp timer 100 is OFF, electricity is not available to its outlet or to the device plugged-in to it. With regard to mechanism 20, it may be plugged-in to the outlet of lamp timer 100 and thereby (AC) electricity may be switched ON and OFF to its means automatically and manually at various times during a 24-hour period.

FIG. 1 and 2 illustrates lamp timer 100 connected in one of the possible operating modes with mechanism 20. For purposes of illustration, lamp timer 100 is shown as a electromechanical type similar to the Intermatics Incorporated Model SB711C, although virtually any other manufacturer's model may be substituted, including digital timers. Also suitable for this purpose are the so-called timer/controllers. These devices consist of a command console with a 24-hour clock mechanism and programmable actuation means, and a means to send coded electrical signals through a building wiring system to cause the actuation of one or more companion switch modules plugged-in at various other wall outlets. A lamp and appliance plugged-in to the outlet of a companion switch module may be turned ON and OFF by the means of the command console and companion switch module at various times during a 24-hour period. An example of this type of timer/controller means is Tandy Corporation's Radio Shack Controller Timer with separate Appliance Module Catalog Numbers 61-2670 and 61-2681 respectively. With regard to mechanism 20, it may be plugged-in to the outlet of the desired companion switch module and thereby (AC) electricity may be switched ON and OFF to its means automatically at various times of the day.

Figure 3A:
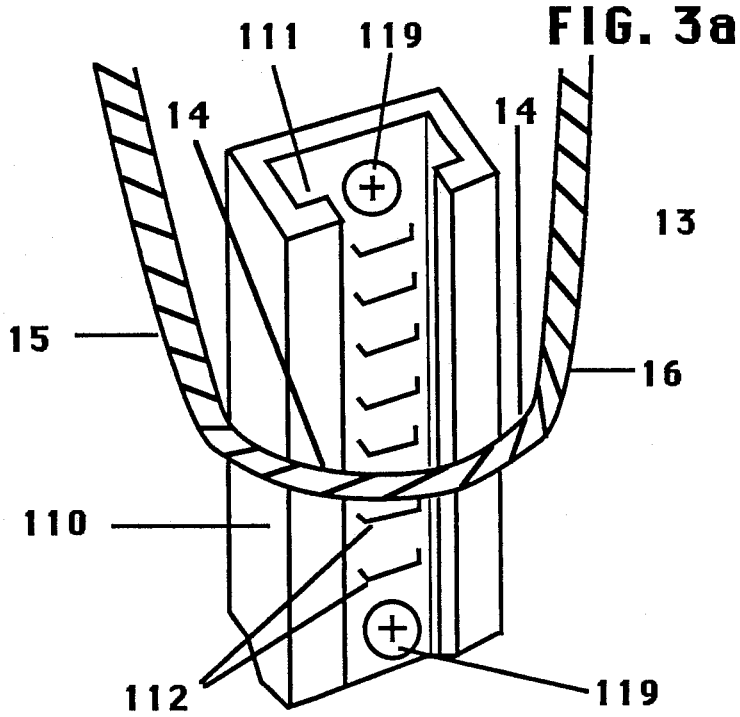
FIG. 3*a* illustrates the mounting bracket of the invention affixed to a wall near the bight of the drapery pull-cord.
Figure 3B:
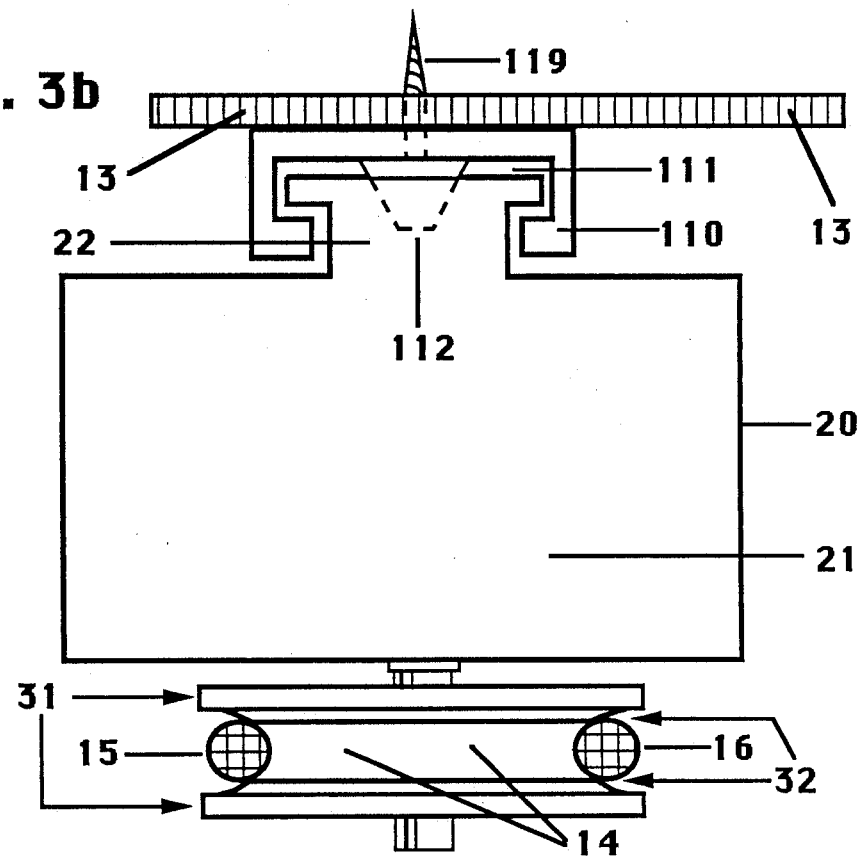
FIG. 3*b* is a view looking upward from beneath the invention showing how the main housing is assembled to and retained within the means of the mounting bracket, and the pull-cord engaged with the drive means of the invention.

Installation and set-up of mechanism 20 is accomplished as follows. As illustrated in FIG. 3*a*, using mounting screws 119, mounting bracket 110 is affixed to wall 13 at a location centered between reaches 15 and 16, near bight 14. As illustrated in FIG. 3*b*, with mounting bracket 110 affixed to wall 13, profile 22 of the main housing 21 is inserted into channel 111 of mounting bracket 110. Main housing 21 is then adjusted vertically within channel 111 so that bight 14 is engaged within groove 32 of the drive means 31. Main housing 21 is then pushed downward to forcibly engage bight 14 in drive means 31. While maintaining said downward pressure, the main housing 21 is tilted so that its profile 22 is engaged with the retainer means 112 provided by bracket 110. The forcible engagement between bight 14 and pulley drive means 31 is thereby maintained. As illustrated in FIG. 1 and 2, with bight 14 fully engaged with drive means 31, limit switch actuators 68 and 69 are attached one each to reaches 15 and 16 as follows: actuator 68 is attached to reach 15 in actuation proximity to limit switch 65 after draperies 10 and 11 have been adjusted to the first desired closed position setting 18, and actuator 69 is attached to reach 16 in actuation proximity to limit switch 66 after draperies 10 and 11 have been adjusted to the second desired closure position setting 19. Actuators 68 and 69 are interchangeable and thereby may be attached to either reach. Actuators 68 and 69 are also independently adjustable, thereby closure position settings 18 and 19 may subsequently be changed to any setting possible within the means of drapery rod 12, and one may be changed without regard to the other.

After installation as above, mechanism 20 may be controlled in three general ways, with each way providing a mode of operation having unique features. For reference, examples of these modes of operation are named as follows: Example one (1); wireless remote control operation. Example two (2); lamp timer operation. Example three (3); remote control and lamp timer operation. The following examples of these operating modes assumes that installation and set-up of mechanism 20 has been completed as previously described, and that draperies 10 and 11 are located at either of the two closure position settings and thereby an actuator affixed to a reach is causing the actuation of a limit switch.

Figure 4:
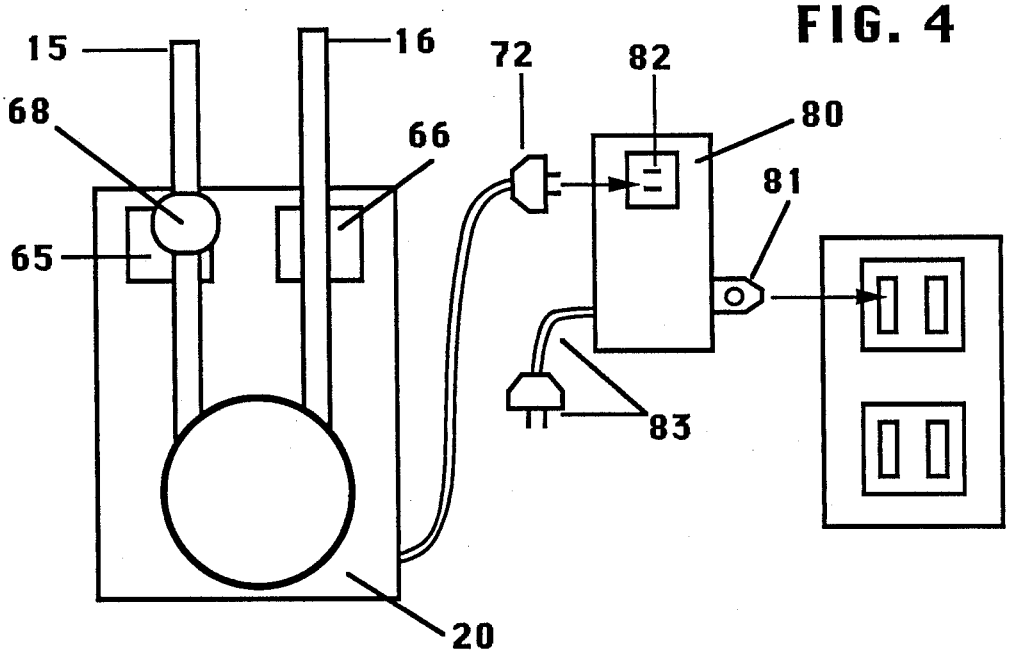
FIG. 4 illustrates the invention connected in an alternate configuration whereby the components of the remote control system are used as the only control means of the invention.

Example one (1); connecting mechanism 20 for the wireless remote control operation. As illustrated in FIG. 4, plug 81 of receiver/controller unit 80 is plugged-in to a standard electrical wall outlet where alternating current (AC) electricity is continuously available. Plug 72 of mechanism 20 is plugged-in to outlet 82 of receiver/controller unit 80. Mechanism 20 is now ready for use in the wireless remote control operation mode. As illustrated in FIG. 6, receiver/controller unit 80 comprises a radio frequency receiver 85 and a double-pole double-throw latching relay switch 87 with actuation coil 89. Receiver/controller 80 further comprises circuit means whereby the conductors of jumper cable 83 are wired to the normally closed terminal means 84 of relay 87, and whereby the conductors of outlet 82 are wired to the pole means 86 of relay 87, and whereby the conductors of plug 81 are wired to the normally open terminal means 88 of relay 87, and whereby the conductors of plug 81 are also wired to the means of receiver 85 to thereby provided (AC) electricity for its operation. When mechanism 20 is connected for the wireless remote control operation mode, jumper cable 83 is not plugged-in to any means of electricity, thereby when relay 87 is not actuated, its switch means remain engaged with its normally closed terminal means 84 and thereby electricity is not available to poles 86, or to outlet 82, or to the means of mechanism 20. Relay 87 does not provide a circuit whereby electricity can exit jumper cable 83, thereby there is no safety hazard when jumper cable 83 is exposed. To cause mechanism 20 to operate, the provided hand-held wireless remote control transmitter 95 is actuated from some distance. Thereby, radio frequency receiver 85 receives the signal from transmitter 95 and actuates coil 89 causing the switch means of relay 87 to become engaged with the normally open terminal means 88 and latch in that position. Thereby, when the switch means of relay 87 engages the normally open terminal means 88, a circuit is completed whereby electricity from the wall outlet is available to the normally open terminal means 88 and thereby is provided to the engaged switch contact means, and whereby each switch contact has a pole means 86, electricity is thereby available to outlet 82 by the circuit means previously described. Thereby electricity is available to the means of connected mechanism 20 and it is caused to operate. Draperies 10 and 11 are thereby repositioned to the other closure position setting whereby the operation of mechanism 20 is terminated by a means provided by mechanism 20 eventhough electricity continues to be provided to it; described in more detail later. At a subsequent time the hand-held wireless remote control transmitter 95 is again actuated and radio frequency receiver 85 causes coil 89 to unlatch the switch means of relay 87, whereby its switch means return to normally closed position 84, and thereby the circuit to the electrical wall outlet is opened and electricity is terminated to the means of mechanism 20 causing its means to be reset for a subsequent operation cycle; described in more detail later.

Example two (2); connecting mechanism 20 for the lamp timer operation. Lamp timer 100 may be any of the large variety of commercially available clock actuated switches that are commonly used to turn lamps ON and OFF at desired times of the day. Lamp timer 100 is manually set to an OFF position with the means it provides, and then plugged-in to a standard electrical wall outlet where (AC) electricity is continuously available. Plug 72 of mechanism 20 is then plugged-in to the outlet of the lamp timer 100 as illustrated in FIG. 1 and 2. Mechanism 20 is now ready for use in the lamp timer operation mode. Hereafter, at a time of the day determined by the adjustable clock actuation means of lamp timer 100, its switch is automatically switched ON and thereby a circuit is completed which permits electricity from the wall outlet to be available to the outlet of lamp timer 100, and thereby electricity is provided to connected mechanism 20. As previously stated, draperies 10 and 11 are located at a closure position setting and thereby an actuator affixed to a reach is causing the actuation of a limit switch. Thereby, when electricity is provided by lamp timer 100, mechanism 20 is caused to operate. Draperies 10 and 11 are thereby repositioned to the other closure position setting whereby the operation of mechanism 20 is terminated by a means provided by mechanism 20 eventhough electricity continues to be provided to it; described in more detail later. At a subsequent time the switch means of lamp timer 100 are switched OFF by its clock actuation means and thereby electricity is terminated to mechanism 20 causing its means to be reset for a subsequent operation cycle; described in more detail later.

Figure 5:
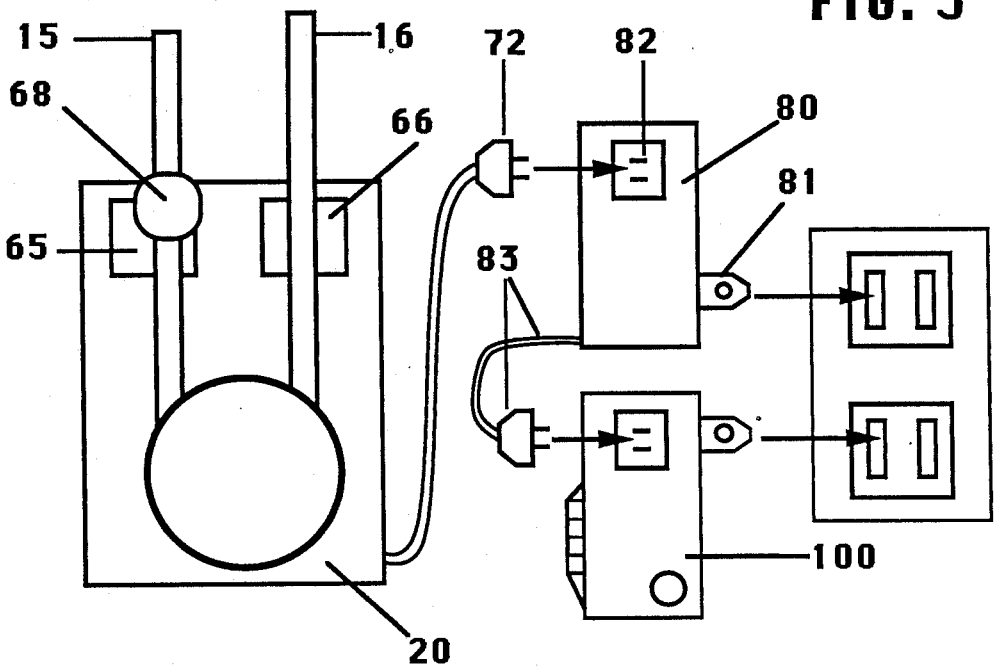
FIG. 5 illustrates the invention connected in an alternate configuration with the remote control system whereby the jumper cable of the receiver/controller unit is plugged-in to the outlet of the lamp timer and thereby establishes a means whereby both may be used as a control means of the invention.

Example three (3); connecting mechanism 20 for remote control and lamp timer operation. To do so, lamp timer 100 is manually set to an OFF position by the means it provides and plugged-in to a standard electrical wall outlet where (AC) electricity is continuously available. Plug 81 of receiver/controller unit 80 is also plugged-in to a standard electrical wall outlet where (AC) electricity is continuously available. Preferably, a double wall outlet is used in order that the lamp timer 100, and the receiver/controller unit 80, may be located one above the other as illustrated in FIG. 5. Plug 72 of mechanism 20 is then plugged-in to outlet 82 of the receiver/controller unit 80. Jumper cable 83 of receiver/controller unit 80 is plugged-in to the outlet of lamp timer 100 thereby establishing an electrical means between the receiver/controller unit 80 and the lamp timer 100. Mechanism 20 is now ready for use in the remote control and lamp timer operation mode. Illustrating the capabilities of this mode requires an explanation of the two control events which most commonly occur. One of these control events is when lamp timer 100 is automatically switched ON by its actuation means while the hand-held wireless remote control transmitter 95 is not actuated. In this event, lamp timer 100 makes a circuit which provides electricity to its outlet, and electricity is thereby available to connected jumper cable 83 and thereby to the normally closed terminal means 84 of relay 87. As illustrated in FIG. 6, since relay 87 has not been actuated, its switch contacts remain engaged with its normally closed terminal means 84, and thereby electricity provided by lamp timer 100 is available to the engaged switch contacts and thereby to pole means 86 and to outlet 82, and thereby to mechanism 20. As previously stated, draperies 10 and 11 are located at a closure position setting and thereby an actuator affixed to a reach is causing the actuation of a limit switch. Thereby when electricity is provided, mechanism 20 is caused to operate. Draperies 10 and 11 are thereby repositioned to the other closure position setting whereby the operation of mechanism 20 is terminated by a means provided by mechanism 20 eventhough electricity continues to be provided to it; described in more detail later. At a subsequent time the switch of lamp timer 100 is automatically switched OFF by its clock actuation means and electricity is terminated to relay 87 and thereby to mechanism 20 causing its means to be reset for a subsequent operation cycle; described in more detail later. Another of the commonly occurring control events of the remote control and lamp timer operating mode is when the hand-held wireless remote control transmitter 95 is actuated while the switch of lamp timer 100 is in an OFF position. In this event, radio frequency receiver 85 receives the transmitted signal of transmitter 95 and it actuates coil 89 causing the switch means of relay 87 to engage the normally open terminal means 88 and to latch in that position. As previously described, when the switch means of relay 87 engages the normally open terminal means 88, a circuit is completed whereby electricity from the wall outlet is available to the normally open terminal means 88 and thereby to the engaged switch contact means, and whereby each switch contact has a pole means 86, electricity is thereby available to outlet 82. Thereby, electricity is available to the means of connected mechanism 20 and it is caused to operate. Draperies 10 and 11 are thereby repositioned to the other closure position setting whereby the operation of mechanism 20 is terminated by a means provided by mechanism 20 eventhough electricity continues to be provided to it; described in more detail later. At a subsequent time the hand-held wireless remote control transmitter 95 is again actuated and radio frequency receiver 85 thereby causes coil 89 to unlatch the switch means of relay 87 whereby its switch means return to the normally closed position 84 and thereby the circuit to the electrical wall outlet is opened and electricity is terminated to mechanism 20 causing its means to be reset for a subsequent operation cycle; described in more detail later. The wiring scheme and circuits providable by receiver/controller 80 are noteworthy because they provide a means whereby mechanism 20 may be operated by lamp timer 100, as well as by transmitter 95 and receiver/controller 80. Further, receiver/controller 80 also provides for electrical safety and assures that only one electrical circuit can be completed to mechanism 20 at any given time. This concludes the description of the three (3) general operating mode examples of mechanism 20.

The following set of descriptions illustrates the features of other provided components of mechanism 20, namely; drive means 31, gear-train 35, motor control 40 with limit switches 65 and 66, actuators 68 and 69, motor 60, power supply 70, hand-held wireless remote control transmitter 95, and mounting bracket 110.

Drive means 31 is unique in that the means of its groove 32 are composed of rubber or other resilient materials or coatings having a high coefficient of friction characteristic. Additionally, the width and depth dimensions of groove 32 approximates the cross-section of the drapery pull-cord whereby the fit between the two may be snug, and whereby engagement may occur on multiple planes. Thereby, drapery pull-cord made of fiber, plastic, metal ball-chain, and other materials may be advanced. When bight 14 is fully engaged in groove 32, and maintained in place by the tension means provided by mounting bracket 110, drive means 31 provides the means to advance reaches 15 and 16 in either direction of rotation.

Motor 60 is an electric reversible motor which operates when direct current (DC) electricity is supplied to its terminal means. It has the means to start and run in either a clockwise or a counter-clockwise direction of rotation, whereby the direction of rotation is determined by the polarity of (DC) electricity available to its terminal means.

As in illustration FIG. 8, gear-train 35 comprises input gear 30 and output shaft 39. Drive means 31 is affixed to output shaft 39. Motor 60 comprises shaft 61 with affixed pinion gear 62. Pinion gear 62 is engaged with input gear 30. Gear-train 35 further comprises reduction gears and means to convert the torque and revolutions per minute speed of motor 60 to the torque and revolutions per minute speed for operation of drive means 31 in either direction of rotation.

Limit switches 65 and 66 are single-pole single-throw normally open reed switches that may be actuated with a magnet. Actuators 68 and 69 are magnets affixed one each to reaches 15 and 16. Other types of limit switches have also been successfully used on test models of mechanism 20, including limit switches actuated by a mechanical means affixed to reaches 15 and 16, thereby, other types of limit switch and actuating means may be substituted. When mechanism 20 operates, reaches 15 and 16 are advanced vertically in opposite directions. This causes one actuator to move upward and away from its actuation position with its assigned limit switch, while the other actuator is advanced downward and toward the actuation position of its assigned limit switch. When an actuator is in actuation position with a limit switch, the switch means of that limit switch are caused to close and available electricity may thereby pass the means of the actuated limit switch. When an actuator moves away from a limit switch, the switch means of that limit switch will thereby return to its normally open position, and electricity is prevented from passing beyond the means of the limit switch.

Figure 9:
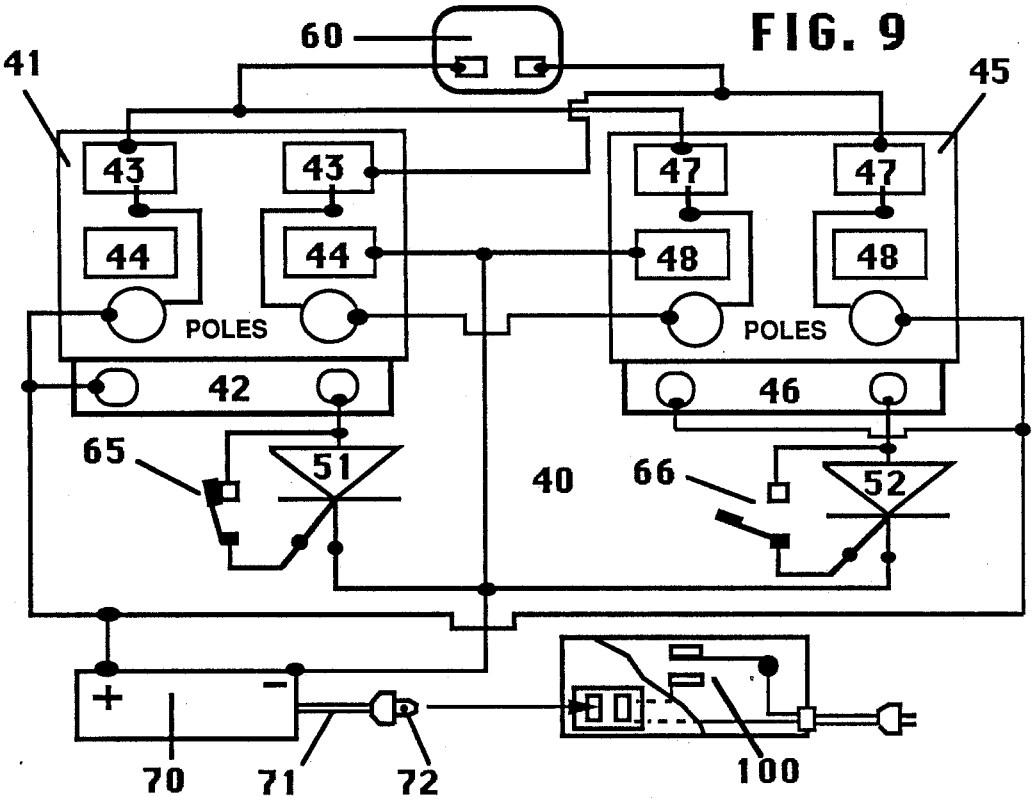
FIG. 9 illustrates the reset condition of the motor control of the invention, showing the switches of the SCRs and relays in their normal switch positions when the (AC) electrical circuit to the power supply is open (without regard to the closed limit switch); depicting the circuits of the invention prior to the initiation of an operation cycle. Also shown is a switch in the (AC) electrical supply circuit that is representational of a lamp timer, or the means of the remote control system, or any other switch means that can cause (AC) electricity to be switched ON and OFF to the power supply of the invention.
Figure 10:
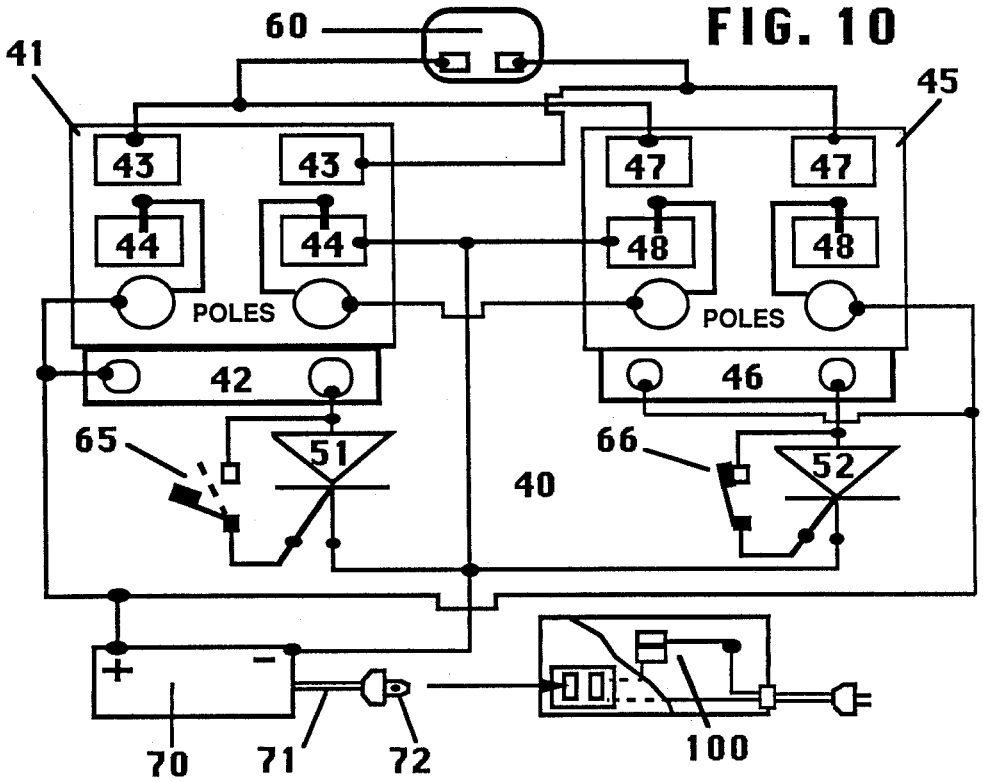
FIG. 10 illustrates the motor control of the invention showing that the motor circuits of both relays are actuated open and therefore the motor is inoperable. Also shown is that the (AC) electrical supply circuit is continuously closed and thereby the power supply has the means and provides (DC) electricity continuously, showing one limit switch currently open after having been closed and its SCR and thereby its relay are maintained in an actuated condition, showing the other limit switch currently closed and thereby its SCR and relay are also actuated; depicting the essential motor control means that can cause the motor to operate and subsequently be switched OFF while (AC) electricity is continuously provided to the invention.
Figure 11:
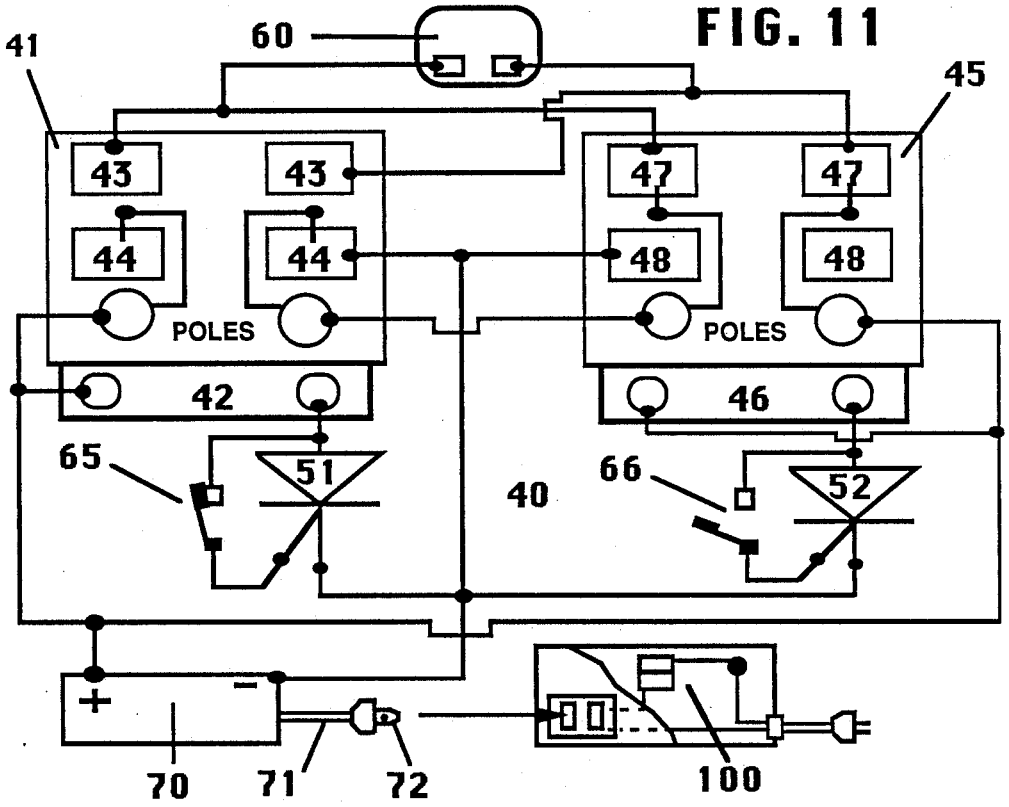
FIG. 11 illustrates the motor control of the invention showing only one limit switch having been closed and thereby only one SCR is actuated and the motor circuit of its relay is open, showing the motor circuit of the other relay remaining closed, the (AC) electrical supply circuit continuously closed and thereby the power supply has the means and provides (DC) electricity continuously; depicting the motor control circuit means to cause the motor to operate in a clockwise direction of rotation when one relay is actuated and the other relay is not actuated.
Figure 12:
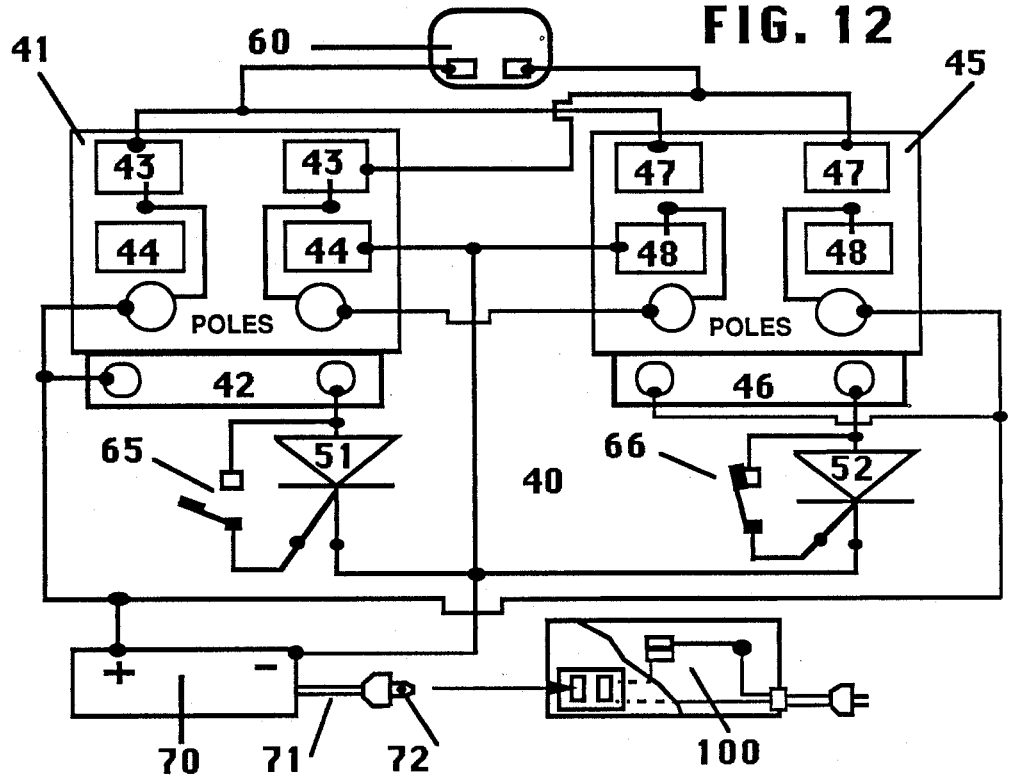
FIG. 12 illustrates the motor control of the invention showing only one limit switch having been closed and thereby only its SCR is actuated and the motor circuit of one relay is open, showing the motor circuit of the other relay remaining closed, the (AC) electrical supply circuit continuously closed and thereby the power supply has the means and provides (DC) electricity continuously; depicting the motor control circuit means to cause the motor to operate in a counter-clockwise direction of rotation when one relay is actuated and the other relay is not actuated.

Motor control 40 consists of the following major components: two (2) double-pole double-throw non-latching relay switches 41 and 45, two (2) SCRs (Thyristors) 51 and 52 herein referred to as SCRs, and two (2) limit switches 65 and 66. The function of motor control 40 is to provide a means to switch direct current (DC) electricity ON and OFF to motor 60 and thereby cause it to start and stop operating, and to provide two motor circuits with opposite electrical polarities to thereby govern the direction of rotation of motor 60 when it is caused to operate. The following illustrates the circuits of motor control 40; and hereafter the term negative is substituted for negative polarity and the term positive is substituted for positive polarity when referring to direct current (DC) electrical polarity. As illustrated in FIG. 9, 10, 11 and 12, each relay has a positive and a negative pole with each pole having a switch contact, and each switch contact has a normally closed and normally open switch position. The normally closed means of each relay are wired to motor 60, and thereby two motor circuits exist that may provide electricity from power supply 70 to motor 60. However, each motor circuit is wired to motor 60 in a way that provides (DC) electricity with a polarity opposite the other motor circuit. Thereby, motor 60 may be caused to operate in a clockwise direction of rotation when electricity is available to it through the motor circuit provided by the first of said relays when it is in its normally closed position, and whereby motor 60 will be caused to operate in a counter-clockwise direction of rotation when electricity is available to it through the motor circuit means provided by the second of said relays when it is in its normally closed position. As illustrated in FIG. 9, 10, 11 and 12, relays 12, electrical cable 71 with plug 72 connects power supply 70 to a switch means such as lamp timer 100, receiver/controller unit 80, or other switch that controls AC electricity. Relays 41 and 45 are wired to power supply 70 in the following way. The negative means of power supply 70 is wired to the negative normally open means (44 and 48) of the relays. The positive means of power supply 70 is wired to the positive poles of each relay. A circuit is provided between both relays whereby their negative normally open means are wired together, and, whereby their negative poles are wired together. Each relay has an actuation means that may cause its switch contacts to become engaged with its normally open means, and when a relay is actuated, thereby its motor circuit is open. The actuation means of each relay is a coil having a positive and a negative means whereby electricity may be provided and thereby cause the switch contacts of the relay to be actuated. When electricity is not provided to the coil of a relay, the relay is not actuated and its switch contacts remain in their normally closed position. Relay 41 has actuation coil 42, and relay 45 has actuation coil 46. The coil means of each relay is wired to a control circuit whereby each control circuit is comprised of the means of one SCR (51 or 52) and one limit switch (65 or 66). As illustrated in FIG. 9, 10, 11 and 12, the wiring scheme for each coil control circuit is as follows: the positive means of each coil is wired to the positive means of power supply 70, and the negative means of each coil is wired to the anode of an SCR whereby the cathode of said SCR is wired to the negative means of power supply 70. Each SCR comprises a normally open switch means in the coil control circuit. When the switch of the SCR is in its normally open position, the coil control circuit is open and thereby the relay is not actuated and its switch contacts remain closed. As is known in the art, the switch means of an SCR is open when electricity is not available to its means, and its switch is also open when electricity is available but if its actuation means have not been actuated. When electricity is available to the means of an SCR, and when its actuation means have been momentarily or continually actuated, the switch of the SCR will thereby close and will remain closed for the duration of time that an uninterrupted supply of electricity is available to its means even if its actuation means subsequently are no longer actuated. As illustrated in FIGS. 9, 10, 11 and 12, the actuation means for each SCR is a circuit between its anode and gate, whereby said circuit comprises the means of a limit switch (65 or 66), whereby each limit switch has an actuation means which may cause its switch means to be closed (68 or 69 affixed one each to reaches 15 and 16 as in illustrations FIG. 1 and 2). Whereas, when (AC) electricity is switched ON to power supply 70, thereby power supply 70 is caused to initiate electricity, and when a limit switch is open, thereby the SCR is not actuated and its switch remains open, thereby the coil control circuit is not actuated and the switch means of the relay remains closed and thereby the motor circuit is closed. Whereas, when (AC) electricity is switched ON to power supply 70, thereby power supply 70 is caused to initiate electricity, and if a limit switch is momentarily or continuously closed, thereby the switch of the SCR is caused to close and it will remain closed for the duration of time that an uninterrupted supply of electricity from power supply 70 is available to its means. Thereby the coil control circuit is closed and will remain closed for the duration of time that power supply 70 provides an uninterrupted supply of electricity to the actuated SCR and thereby the relay will be actuated for said duration of time and its motor circuit will be opened and its switch contacts will engage its normally open terminal means. Thereby, when a limit switch is momentarily or continually actuated while power supply 70 is providing electricity, an SCR is actuated and thereby a relay is actuated and its switch contacts engage its normally open means, and thereby a circuit to the negative means of power supply 70 is completed whereby negative electricity is available to the negative switch means of the actuated relay for the said duration of time that power supply 70 receives an uninterrupted supply of (AC) electricity. As illustrated in FIG. 11 and 12, when (AC) electricity is switched ON to power supply 70, and if one relay has been actuated while the other relay has not been actuated, thereby a circuit is completed to the negative means of power supply 70 and negative electricity is available to the means of both relays by the circuits described between the relays, and thereby motor 60 may be caused to operate. This occurs as follows. When one relay is actuated, its switch contacts engage its normally open means, and whereby the normally open means are wired to the negative means of power supply 70, negative electricity is thereby available to the actuated relay's engaged negative switch contact and thereby to its negative pole. Whereas the negative poles of both relays are wired to each other, thereby negative electricity available to the negative pole of the actuated relay is thereby available to the negative pole and negative switch contact means of the unactuated relay. Whereas the negative switch contact of the unactuated relay is engaged with its normally closed means, and whereas the normally closed means is wired to motor 60, thereby negative electricity is available to motor 60 by the motor circuit of the unactuated relay, and thereby the negative portion of the motor circuit is complete. The positive portion of the motor circuit is also provided by the unactuated relay whereby the positive means of power supply 70 is wired to the positive pole of the unactuated relay and thereby to its positive switch contact, and whereas its positive switch contact is engaged with its positive normally closed means, and whereas its normally closed means is wired to motor 60, thereby the positive motor circuit is complete to motor 60 by the motor circuit of the unactuated relay. Thereby, motor 60 is caused to operate in the direction of rotation as determined by the polarity of the motor circuit of the unactuated relay. As illustrated in FIG. 9, even when a limit switch is closed, neither relay can be actuated unless power supply 70 receives (AC) electricity, thereby motor 60 is inoperable. As illustrated in FIG. 10, if one relay is actuated and the other relay subsequently becomes actuated, motor 60 is inoperable or is made inoperable because both motor circuits are opened. Only when one relay is actuated while the other relay is unactuated are circuits provided to permit motor 60 to operate. This necessary capability of motor control 40 is illustrated by the following description of the normal operating cycles of mechanism 20. An operating cycle of mechanism 20 is ready to commence when one limit switch is actuated closed and when the other limit switch is open (as when draperies 10 and 11 are located at a closure position setting), and, when power supply 70 is OFF and thereby the SCRs and relays of motor control 40 are in their normal switch positions (as when (AC) electricity is not available to the means of mechanism 20). An operating cycle is initiated when a switch means like that of lamp timer 100, or a switch means like that of receiver/controller unit 80, is actuated and thereby (AC) electricity is caused to be available to the connected mechanism 20. Thereby, power supply 70 is caused to provide (DC) electricity to the means of motor control 40. As illustrated in FIG. 1, draperies 10 and 11 are located at closure position 18, and thereby limit switch 65 is closed due to the magnetic force of actuator 68 (affixed to reach 15) which is in near proximity. The other limit switch 66 is in its normally open position because its actuator 69 (affixed to reach 16) is not in near proximity. Thereby, (DC) electricity provided by power supply 70 is available to motor control 40 and said electricity passes the closed switch means of limit switch 65 and causes the actuation of SCR 51. Thereby, as illustrated in FIG. 11, the switch of SCR 51 is caused to close and thereafter will remain closed for the duration of time that power supply 70 provides an uninterrupted supply of electricity even after actuator 68 affixed to reach 15 is moved away and no longer causes the actuation of limit switch 65. Actuated SCR 51 thereby completes the control circuit to coil 42 and relay 41 is caused to switch from its normally closed position 43 to its normally open position 44, and will remain in position 44 for the duration of time that power supply 70 has an uninterrupted supply of (AC) electricity and thereby the means to provide an uninterrupted supply of (DC) electricity to actuated SCR 51. Thereby, a circuit to the negative means of power supply 70 is completed by the negative switch contact of actuated relay 41 engaged with normally open means 44. Whereas, negative electricity from power supply 70 is present at the negative normally open means 44, negative electricity is thereby available to the engaged negative switch contact of actuated relay 41 and thereby to its negative pole, and whereas the negative poles of both relays are wired to each other, negative electricity is available to the negative pole of unactuated relay 45 and thereby to its negative switch contact, and whereas the switch contacts of unactuated relay 45 are engaged with its normally closed means 47, and whereas the negative normally closed means 47 is wired to motor 60, thereby negative electricity is available to cause motor 60 to operate. Further, the positive portion of the motor circuit to permit motor 60 to operate is comprised of the positive means of power supply 70 wired to the positive pole of unactuated relay 45, and whereas its positive switch contact is engaged with its positive normally closed means 47, and whereas the positive normally closed means 47 is wired to motor 60, thereby the positive motor circuit means is completed. Thereby motor 60 will operate in a direction of rotation determined by the polarity of (DC) electricity available to motor 60 by the motor circuit of the unactuated relay 45. Thereby, the circuit means provided by actuated relay 41 and unactuated relay 45 causes motor 60 to operate continuously for the duration of time that power supply 70 receives an uninterrupted supply of (AC) electricity and while the motor circuit of relay 45 is complete. Thereby, limit switch actuator 68 affixed to reach 15 is advanced in a direction away from mechanism 20 and thereby is no longer in actuation proximity with limit switch 65, however, since actuated SCR 51 receives an uninterrupted supply of electricity, its switch means will remain closed and thereby motor control 40 will maintain the circuit means to cause motor 60 to operate continuously until limit switch 66 is actuated. Thereby, actuator 69 affixed to reach 16 is advanced toward limit switch 66, and draperies 10 and 11 are advanced toward closure position 19. Subsequently, draperies 10 and 11 are advanced to closure position 19 whereby actuator 69 is in proximity with limit switch 66 and thereby causes its switch means to close. Electricity from power supply 70 thereby passes the switch means of actuated limit switch 66 and thereby causes the actuation of SCR 52 and its switch means are closed. As illustrated in FIG. 10, thereby, the control circuit to coil 46 is completed and relay 45 is caused to be actuated and its motor circuit is thereby opened and electricity is terminated to motor 60 and it thereby ceases operation. Relay 45 will remain actuated and its motor circuit will remain open and motor 60 will now be inoperable for the duration of time that power supply 70 has an uninterrupted supply of (AC) electricity and thereby the means to provide an uninterrupted supply of (DC) electricity to the means of motor control 40. Thereby, when draperies 10 and 11 are located at a closure position setting, and when a switch causes (AC) electricity to be initiated to the means of mechanism 20, thereby a means of motor control 40 is actuated causing motor 60 to start operating and thereby mechanism 20 advances draperies 10 and 11 away from the said closure position setting toward another closure position setting. Thereby, when mechanism 20 repositions draperies 10 and 11 from one closure position setting to another closure position setting, an additional means of motor control 40 is actuated and motor 60 is made inoperable and mechanism 20 ceases operating eventhough (AC) electricity may continue to be provided to the means of mechanism 20. Thereby motor control 40 provides the means to cause motor 60 to start operating when draperies 10 and 11 are located at a closure position setting when (AC) electricity is initiated by a switch, and thereafter motor control 40 has the means to terminate the operation of motor 60 even while (AC) electricity continues to be provided after draperies 10 and 11 have been repositioned to another closure position setting by mechanism 20. Whereas a switch means, like that of lamp timer 100, does not provide an automatic actuation means to cause mechanism 20 to terminate operation when draperies 10 and 11 are repositioned from one closure position setting to another, thereby motor control 40 provides this essential means, and thereby mechanism 20 may be connected with and operated by virtually any lamp timer 100 or other switch means. Whereas mechanism 20 advances draperies 10 and 11 between closure position settings in generally less than one (1) minute, and whereas the ON to OFF actuation cycle time of the typical lamp timer 100 is greater than five (5) minutes, thereby in the course of the normal operating cycle of a typical lamp timer 100, its clock actuation means causes its switch to switch OFF at a time considerably after draperies 10 and 11 are repositioned from one closure position setting to another, thereby (AC) electricity is terminated to the means of connected mechanism 20 at a time considerably after draperies 10 and 11 have been repositioned, and thereby motor control 40 provides the essential means to terminate the operations of motor 60 when draperies 10 and 11 have been repositioned. Whereby (AC) electricity is terminated to the means of mechanism 20, power supply 70 thereby terminates (DC) electricity to the means of motor circuit 40, and thereby the SCRs no longer have the electrical means to maintain their actuated condition and their switches return to their normally open positions, and thereby the coils of each actuated relay are no longer actuated and their switches return to their normally closed position. Thereby, when a switch means like lamp timer 100 or receiver/controller 80 is opened and causes (AC) electricity to be terminated to power supply 70, a reset condition of motor control 40 occurs whereby the SCRs and relays are in their normal switch positions (without regard to whether a limit switch is actuated) and thereby mechanism 20 is ready for the next operation cycle as illustrated in FIG. 9. Since, actuators 68 and 69 affixed to the reaches 15 and 16 were repositioned when draperies 10 and 11 were advanced from closure position setting 18 to closure position setting 19 during the preceding operating cycle, limit switch 65 is open and limit switch 66 is closed as illustrated in FIG. 12. Thereby, the reset motor control 40 and the most recently actuated limit switch 66 provide the means to cause motor 60 to operate in the opposite direction of rotation when (AC) electricity is again initiated to the means of connected mechanism 20. Whereby the next operating cycle occurs and motor 60 operates in the opposite direction when a switch means like that of lamp timer 100, or a switch means like that of receiver/controller 80, is actuated to cause (AC) electricity to be initiated to the means of mechanism 20. As illustrated in FIG. 12, power supply 70 provides (DC) electricity to motor control 40 whereby (DC) electricity passes the closed switch means of limit switch 66 and causes the actuation of SCR 52 and its switch is caused to closed. Thereby, the actuated SCR 52 completes the control circuit to coil 46 and thereby relay 45 is caused to switch from its normally closed position 47 to its open position 48 and will remain in position 48 for the duration of time that power supply 70 has an uninterrupted supply of (AC) electricity and thereby the means to provide an uninterrupted supply of (DC) electricity to the actuated means of SCR 52, even after actuator 69 affixed to reach 16 moves away and limit switch 66 is no longer acutated. Thereby, the motor circuit of relay 45 is opened and its negative switch contact engages the negative normally open means 48 and thereby a circuit is completed to the negative means of power supply 70. Whereas negative electricity from power supply 70 is present at the negative normally open means 48, negative electricity is thereby available to the engaged negative switch contact of actuated relay 45 and thereby to its negative pole, and whereas the negative poles of both relays are wired to each other, negative electricity is available to the negative pole of unactuated relay 41 and thereby to its negative switch contact, and whereas the negative switch contact of unactuated relay 41 is engaged with its negative normally closed means 43, and whereas the normally closed means 43 is wired to motor 60, thereby negative electricity is available to cause motor 60 to operate. Further, the positive portion of the motor circuit is comprised of the positive means of power supply 70 wired to the positive pole of unactuated relay 41, and whereas its positive switch contact is engaged with its positive normally closed means 43, and whereas the positive normally closed means 43 is wired to motor 60, thereby the positive motor circuit means is completed. Thereby an electrical circuit is completed between power supply 70 and motor 60 by the circuit means provided by actuated relay 45 and unactuated relay 41, and motor 60 is thereby caused to operate continuously for the duration of time that power supply 70 has an uninterrupted supply of (AC) electricity and thereby the means to provide an uninterrupted supply of (DC) electricity to the means of motor control 40. However, on this operating cycle, motor 60 is caused to operate in the reverse direction of rotation as the previous cycle because relay 45 is actuated while relay 41 is unactuated, and the motor circuit means of relay 41 provides electricity to motor 60 with a (DC) polarity that is opposite of that of relay 45. Thereby, reach 16 is advanced in a direction away from mechanism 20, while reach 15 is advanced toward it, and in so doing, actuator 69 moves away from limit switch 66, while actuator 68 moves toward limit switch 65. Since actuated SCR 52 receives an uninterrupted supply of electricity, motor control 40 maintains the circuit means to cause motor 60 to operate continuously until limit switch 65 is actuated Subsequently, when draperies 10 and 11 are repositioned from closure position 19 to closure position 18, actuator 68 is in actuation proximity with limit switch 65 and causes it to close. Thereby, electricity from power supply 70 passes the switch means of actuated limit switch 65 to cause the actuation of SCR 51. Thereby the actuated SCR 51 completes the control circuit to coil 42 and relay 41 is actuated and its motor circuit is opened causing the termination of electricity to motor 60 which ceases operation. Relay 41 will now remain actuated and its motor circuit will remain open for the duration of time that power supply 70 provides an uninterrupted supply of electricity to the actuated SCR 51. Thereby, both relays have been actuated and both are maintained in an actuated condition for the duration of time that power supply 70 has an uninterrupted supply of (AC) electricity and thereby the means to provide an uninterrupted supply of (DC) electricity to the means of motor control 40, and thereby motor 60 is inoperable. As previously described, whereas a switch means like that of lamp timer 100 does not provide for automatic actuation to cause the termination of mechanism 20 when draperies 10 and 11 are repositioned from one closure position setting to another closure position setting, thereby motor control 40 provides this essential means, and thereby mechanism 20 may be connected with and operated by virtually any lamp timer 100 or other switch means. Whereas in the couse of the normal operating cycle of a typical lamp timer 100, its means switches OFF after draperies 10 and 11 are repositioned from one closure position setting to another, thereby motor control 40 provides the essential means to terminates the operation of motor 60 when draperies 10 and 11 have been repositioned. When (AC) electricity is terminated to the means of mechanism 20, power supply 70 thereby terminates (DC) electricity to the means of motor control 40 and the reset condition of motor control 40 occurs whereby the SCRs no longer have the electrical means to maintain their actuated condition and thereby their switches return to their normally open position and thereby the coil of each actuated relay is no longer actuated and thereby their switches return to their normally closed position. And whereby actuators 68 and 69 affixed to reaches 15 and 16 have been repositioned when draperies 10 and 11 were advanced from closure position setting 19 to closure position setting 18, thereby limit switch 65 is now closed and limit switch 66 is now open. Whereas motor control 40 was caused to be reset when (AC) electricity was terminated, and whereas limit switch 65 is now closed, thereby the next operation cycle may occur when a switch means like that of lamp timer 100, or a switch means like that of receiver/controller 80, is actuated and thereby electricity is again initiated to the means of connected mechanism 20. Thereby, a normal operating cycle of mechanism 20 occurs when draperies 10 and 11 are locate at a closure position setting and then (AC) electricity is initiated to the means of mechanim 20. Thereby mechanism 20 causes draperies 10 and 11 to be repositioned to another closure position setting whereby mechanism 20 has the means to terminate its operation. Whereafter, when (AC) electricity is caused to be terminated to mechanism 20, thereby the means of mechanism 20 are reset and thereby the normal operating cycle of mechanism 20 ends. Thereafter a normal operating cycle of mechanism 20 may be repeated and caused to occur automatically each time that (AC) electricity is initiated to the means of mechanism 20 when draperies 10 and 11 are located at a closure position setting. Thereby mechanism 20 provides the means whereby virtually any commercially available lamp timer 100 may be used to initiate (AC) electricity to the means of mechanism 20, and thereby lamp timer 100 is useable as an actuation means to begin a normal operating cycle of mechanism 20. Whereby mechanism 20 is caused to reposition the closure members to another closure position setting automatically at desired times of the day when the clock actuation means of lamp timer 100 causes its switch to provide (AC) electricity to it, and whereby lamp timer 100 is useable to automatically end the normal operating cycle of mechanism 20 whereby the clock actuation means of lamp timer 100 causes its switch to terminate (AC) electricity to the means of mechanism 20 after the closure members have been repositioned to another closure position setting causing the means of mechanism 20 to be reset for an subsequent operating cycle, thereby lamp timer 100 is useable to initiate and end a normal operating cycle of mechanism 20. Whereby a remote control systen is a provided means of mechanism 20, and whereby the remote control system comprises the means of receiver/controller unit 80 and transmitter 95 as illustrated in FIG. 6 and 7, thereby the remote control system may be used to switch (AC) electricity ON and OFF to the means of mechanism 20, and thereby the remote control system is useable as an actuation means to begin a normal operating cycle of mechanism 20 whereby mechanism 20 is caused to reposition the closure members to another closure position setting when the remote control system is actuated to initiate (AC) electricity to the means of mechanism 20. Whereby the remote control system is again actuated and (AC) electricity is thereby terminated to mechanism 20 after the closure members have been repositioned to another closure position setting, thereby the means of mechanism 20 are reset for a subsequent operating cycle, and thereby the remote control system is useable to end the normal operating cycle of mechanism 20. Whereby the remote control system has the previously described transmitter and means to integrate its operating function with the operating functions of virtually and commercially available lamp timer 100, thereby when lamp timer 100 is connected with the means of receiver/controller 80, their integrated means and the means of motor control 40 and mechanism 20 provide the means to reposition the closure members from one closure position setting to another closure position setting at virtually any desired time, and the means to be reset for a subsequent operating cycle.

(DC) power supply 70 provides the means to convert alternating current (AC) electricity to direct current (DC) electricity for operation of the means of mechanism 20. Power supply 70 has the means to connect with the outlet of a means of electricity whereby alternating current (AC) may be switched ON and OFF.

The hand-held wireless remote control transmitter 95 complies with United States FCC Rules Part 15. As illustrated in FIG. 7, transmitter 95 has circuit means and battery 96, normally-open switch 97, and an ordinary signal transmitter 98 already known in the art that can transmit a radio frequency signal over some distance. As illustrated in FIG. 6, receiver/controller 80 comprises an ordinary radio frequency receiver 85 already known in the art that will respond to the radio frequency signal from transmitter 95 and thereby causes the switch means of relay 87 to open and close as previously described. Mechanism 20 may thereby be caused to operate. Transmitter 95 is useful in operating mechanism 20 from a distance. Receiver/controller 80 and transmitter 95 may be used as the only actuation means of mechanism 20. Or, if lamp timer 100 is also installed for operation of mechanism 20 and connected with receiver/controller unit 80 as previously described, transmitter 95 may be used to actuate mechanism 20 during the periods when the switch means of lamp timer 100 are OFF, and thereby mechanism 20 may be caused to operate at virtually and desired time. An ordinary infrared transmitter and receiver known in the art has also been successfully used as a remote control means on test models of mechanism 20, and thereby this and other types of remote control having an (AC) switch means may be substituted for this purpose.

As illustrated in FIG. 3*b*, when mounting bracket 110 is affixed to wall 13, profile 22 of mechanism 20 may be inserted into channel 111 and engaged with retainer means 112. As previously described, bight 14 is forcibly engaged and maintained within the means of groove 32 of drive puller means 31 in this manner. Thus, a tension means is provided between mechanism 20, bight 14 of reaches 15 and 16, and drapery rod 12. At desired times, and during an electrical power outage, draperies 10 and 11 may be opened and closed by the traditional hand method of operation o the reaches without disassembling mechanism 20 from mounting bracket 110. This is accomplished by simply pressing downward on housing 21 and disengaging profile 22 from retainer means 112. Then a slight upward lift of mechanism 20 relieves the tension and may leave drive pulley means 31 loosely engaged with bight 14 or completely disengaged. Reaches 15 and 16 may thereby be hand-operated to reposition draperies 10 and 11. On other occasions, tension may need to be increased due to stretching of reaches 15 and 16. This too may be easily accomplished without disassembling mounting bracket 110 by simply pressing housing 21 downward and reengaging profile 22 into a lower section of retainer means 112.

The disclosure of the invention described herein represents the preferred embodiment of an improved drapery actuator that is operated by a lamp timer and a wireless remote control system. It should be apparent to those skilled in the art that the invention permits of variations therefrom in its form, construction, arrangement, application, and detail; in whole and in part. I claim as my invention all such variations within the spirit and scope of the following claims.

I claim:

1. A mechanism for driving operable means of one or more movable members comprised in an assembly means, wherein said mechanism drives said movable members between position settings, said position setting comprise any two positions selectable within range of motion of said movable members, said mechanism comprising:

drive means for driving engagement with said operable means;

actuating means for establishing said position settings;

motor control means comprising automatic reset means for controlling automatic operation and for resetting said mechanism, said motor controll means is responsive to said actuating means;

electric reversible motor means having shaft means, said drive means is affixed to said shaft means and thereby rotatable in either direction around its axis by said motor means, said motor means is responsive to said motor control means;

conductor means having plug means for connecting said motor control means to an outlet means of an electric wall receptacle means, wherein a wall switch means switches electricity ON and OFF to said outlet means.

2. The mechanism of claim 1, wherein said mechanism further comprises mounting and tension means, said mounting and tension means comprise an attachment means for adjustably affixing to a surface in proximity to said operables means, said mounting and tension means further comprise receiving means;

wherein said mechanism further comprises housing means for said motor control means and said motor means, said housing means comprise connectors means, said connector means is adjustably assembled with said receiving means for adjustably joining said housing means with said mounting and tension means and for adjustably engaging said drive means with said operable means, thereby said driving engagement is established, wherein said driving eengagement is adjustable for forcible driving engagement for minimizing slippage, wherein said forcible driving engagement is increasable and maintainable and relievable.

3. The mechanism of claim 1, wherein said driving engagement is established thereby said mechanism controls said operable means;

said position settings comprise a first position setting and a second position setting, said actuating means comprise first actuating means and second actuating means;

said actuating means are adjustable for adjustably establishing said position settings, said first actuating means cause actuation of said motor control means when said movable members are located at said first position setting, said second actuating means cause actuation of said motor control means when said movable members are located at said second position setting;

when said electricity is switched OFF thereby said automatic reset means cause said motor control means to reset and thereby said mechanism is ready for said automatic operation, said automatic operation comprises a first operating cycle and a second operating cycle;

said first operating cycle is caused when said electricity is switched ON while said movable members are located at said first position setting, said first operating cycle comprises said first actuating means causing actuation of said motor control means for causing said motor means to operate for driving said movable members to said second position setting, when said movable members are driven to said second position setting thereby said second actuating means causes actuation of said motor control means for causing said motor means to stop operating and thereby terminating said first operating cycle, thereby said movable members remain at said second position setting, when said electricity is subsequently switched OFF thereby said mechanism is ready for said automatic operation and said second operating cycle will occur when said electricity is switched ON;

said second operating cycle is caused when said electricity is switched ON while said movable members are located at said second position setting, said second operating cycle comprises said second actuating means causing actuation of said motor control means for causing said motor means to operate for driving said movable members to said first position setting, when said movable members are driven to said first position setting thereby said first actuating means causes actuation of said motor control means for causing said motor means to stop operating and thereby terminating said second operating cycle, thereby said movable members remain at said first position setting, when said electricity is subsequently switched OFF thereby said mechanism is ready for said automatic operation and said first operating cycle will occur when said electricity is switched ON.

4. The mechanism of claim 1, wherein said motor control means comprise first switching means and second switching means;

said automatic reset means cause said motor control means to reset when said electricity is switched OFF;

when said electricity is switched ON and said first switching means is actuated thereby said motor means runs in a clockwise rotation, said motor means runs continuously in said clockwise rotation until said second switching means is actuated and thereby said motor means is caused to stop running while said electricity remains ON;

when said electricity is switched ON and said second switching means is actuated thereby said motor means runs in a counter-clockwise rotation, said motor means runs continuously in said counter-clockwise rotation until said first switching means is actuated and thereby said motor means is caused to stop running while said electricity remains ON.

5. The mechanism of claim 1, wherein said motor control means comprises first switching means and second switching means for controlling motor circuit means and thereby for controlling said motor means;

means said electricity is provided and when said first switching means and said second switching means are not actuated thereby said motor means is not operable;

when said electricity is provided and when said first switching means and said second switching means are actuated thereby said motor means is not operable;

when said electricity is provided and when said first switching means is actuated and said second switching means is not actuated thereby said motor means operates continuously in a clockwise direction of rotation;

when said electricity is provided and when said first switching means is not actuated and said second switching means is actuated thereby said motor means operates continuously in a counter-clockwise direction of rotation;

when said electricity is provided and uninterrupted and when said first switching means is actuated thereby said first switching means remains actuated;

when said electricity is provided and uninterrupted and when said second switching means is actuated thereby said second switching means remains actuated;

said first switching means and said second switching means are responsive to said automatic reset means, when said electricity is interruptes, said first switching means and said second switching means are reset.

6. A mechanism for driving operable means of one or more movable members comprised in an assembly means, wherein said mechanism drives said movable members between position settings, said position settings comprise any two positions selectable within range of motion of said movable members, said mechanism comprising:

drive means for driving engagement with said operable means;

actuating means for establishing said position settings;

motor control means comprising automatic reset means for controlling automatic operation and for resetting said mechanism, said motor control means is responsive to said actuating means;

electric reversible motor means having shaft means, said drive means is affixed to said shaft means and thereby rotatable in either direction around its axis by said motor means, said motor means is responsive to said motor control means;

conductor means for connecting said motor control means to an electric supply means, said electric supply means comprising a switching means for switching electricity ON and OFF.

7. The mechanism of claim 6, wherein said mechanism further comprises mounting and tension means, said mounting and tension means comprise an attachment means for adjustably affixing to a surface in proximity to said operable means, said mounting and tension means further comprise receiving means;

wherein said mechanism further comprises housing means for said motor control means and said motor means, said housing means comprise connector means, said connector means is adjustably assembled with said receiving means for adjustably joining said housing means with said mounting and tension means and for adjustably engaging said drive means with said operable means, thereby said driving engagement is established, wherein said driving engagement is adjustable for forcible driving engagement for minimizing slippage, wherein said forcible driving engagement is increasable and maintainable and relievable.

8. The mechanism of claim 6, wherein said driving engagement is established thereby said mechanism controls said operable means;

said position settings comprise a first position setting and a second position setting, said actuating means comprise first actuating means and second actuating means;

said actuating means are adjustable for adjustably establishing said position settings, said first actuating means cause actuation of said motor control means when said movable members are located at said first position setting, said second actuating means cause actuation of said motor control means when said movable members are located at said second position setting;

when said electricity is switched OFF thereby said automatic reset means cause said motor control means to reset and thereby said mechanism is ready for said automatic operation, said automatic operation comprises a first operating cycle and a second operating cycle;

said first operating cycle is caused when said electricity is swithed ON while said movable members are located at said first position setting, said first operating cycle comprises said first actuating means causing actuation of said motor control means for causing said motor means to operate for driving said movable members to said second position setting, when said movable members are driven to said second position setting thereby said second actuating means causes actuation of said motor control means for causing said motor means to stop operating and thereby terminating said first operating cycle, thereby said movable members remain at said second position setting, when said electricity is subsequently switched OFF thereby said mechanism is ready for said automatic operation and said second operating cycle will occur when said electricity is switched ON;

said second operating cycle is caused when said electricity is switched ON while said movable members are located at said second position setting, said second operating cycle comprises said second actuating means causing actuation of said motor control means for causing said motor means to operate for driving said movable members to said first position setting, when said movable members are driven to said first position setting thereby said first actuating means causes actuation of said motor control means for causing said motor means to stop operating and thereby terminating said second operating cycle, thereby said movable members remain at said first position setting, when said electricity is subsequently switched OFF thereby said mechanism is ready for said automatic operation and said first operating cycle will occur when said electricity is switched ON.

9. The mechanism of claim 6, wherein said motor control means comprise first switching means and second switching means;

said automatic reset means cause said motor control means to reset when said electricity is switched OFF;

when said electricity is switched ON and said first switching means is actuated thereby said motor means runs in a clockwise rotation, said motor means runs continuously in said clockwise rotation until said second switching means is actuated and thereby said motor means is caused to stop running while said electricity remains ON;

when said electricity is switched ON and said second switching means is actuated thereby said motor means runs in a counter-clockwise rotation, said motor means runs continuously in said counter-clockwise rotation until said first switching means is actuated and thereby said motor means is caused to stop running while said electricity remains ON.

10. The mechanism of claim 6, wherein said motor control means comprises first switching means and second switching means for controlling motor circuit means and thereby for controlling said motor means;

when said electricity is provided and when said first switching means and said second switching means are not actuated thereby said motor means is not operable;

when said electricity is provided and when said first switching means and said second switching means are actuated thereby said motor means is not operable;

when said electricity is provided and when said first switching means is actuated and said second switching means is not actuated thereby said motor means operates continuously in a clockwise direction of rotation;

when said electricity is provided and when said first switching means is not actuated and said second switching means is actuated thereby said motor means operates continuously in a counter-clockwise direction of rotation;

when said electricity is provided and uninterrupted and when said first switching means is actuated thereby said first switching means remains actuated;

when said electricity is provided and uninterrupted and when said second switching means is actuated thereby said second switching means remains actuated;

said first switching means and said second switching means are responsive to said automatic reset means, when said electricity is interrupted, said first switching means and said second switching means are reset.

11. A mechanism for driving operable means of one or more movable members comprised in an assembly means, wherein said mechanism drives said movable members between position settings, said position settings comprise any two positions selectable within range of motion of said movable members, said mechanism comprising:

drive means for driving engagement with said operable means;

actuating means for establishing said position settings;

motor control means comprising automatic reset means for controlling automatic operation and for resetting said mechanism, said motor control means is responsive to said actuating means;

electric reversible motor means having shaft means, said drive means is affixed to said shaft means and thereby rotatable in either direction around its axis by said motor means, said motor means is responsive to said motor control means;

conductor means having plug means for connecting said motor control means to an outlet means of a clock actuated switch means, said clock actuated switch means is connected to an electric supply means, said clock actuated switch means comprises timer controlled switching means for switching electricity ON and OFF to said outlet means.

12. The mechanism of claim 11, wherein said mechanism further comprises mounting and tension means, said mounting and tension means comprise an attachment means for adjustably affixing to a surface in proximity and said operable means, said mounting and tension means further comprise receiving means;

wherein said mechanism further comprises housing means for said motor control means and said motor means, said housing means comprise connector means, said connector means is adjustably assembled with said receiving means for adjustably joining said housing means with said mounting and tension means and for adjustably engaging said drive means with said operable means, thereby said driving engagement is established, wherein said driving engagement is adjustable for forcible driving engagement for minimizing slippage, wherein said forcible driving engagement is increasable and maintainable and relievable.

13. The mechanism of claim 11, wherein said driving engagement is established thereby said mechanism controls said operable means;

said position settings comprise a first position setting and a second position settings, said actuating means comprise first actuating means and second actuating means;

said actuating means are adjustable for adjustably establishing said position settings, said first actuating means cause actuation of said motor control means when said movable members are located at said first position setting, said second actuating means cause actuation of said motor control means when said movable members are located at said second position setting;

when said electricity is switched OFF thereby said automatic reset means cause said motor control means to reset and thereby said mechanism is ready for said automatic operation, said automatic operation conprises a first operating cycle and a second operating cycle;

said first operating cycle is caused when said electricity is switched ON while said movable members are located at said first position setting, said first operating cycle comprises said first actuating means causing actuation of said motor control means for causing said motor means to operate for driving said movable members to said second position setting, when said movable members are driven to said second position setting thereby said second actuating means causes actuation of said motor control means for causing said motor means to stop operating and thereby terminating said first operating cycle, thereby said movable members remain at said second position setting, when said electricity is subsequently switched OFF thereby said mechanism is ready for said automatic operation and said second operating cycle will occur when said electricity is switched ON;

said second operating cycle is caused when said electricity is switched ON while said movable members are located at said second position setting, said second operating cycle comprises said second actuating means causing actuation of said motor control means for causing said motor means to operate for driving said movable members to said first position setting, when said movable members are driven to said first position setting thereby said first actuating means causes actuation of said motor control means for causing said motor means to stop operating and thereby terminating said second operating cycle, thereby said movable members remain at said first position setting, when said electricity is subsequently switched OFF thereby said mechanism is ready for said automatic operation and said first operating cycle will occur when said electricity is switched ON.

14. The mechanism of claim 11, where said motor control means comprise first switching means and second switching means;

said automatic reset means cause said motor control means to reset when said electricity is switched OFF;

when said eletricity is switched ON and said first switching means is actuated thereby said motor means runs in a clockwise rotation, said motor means runs continuously in said clockwise rotation until said second switching means is actuated and thereby said motor means is caused to stop running while said electricity remains ON;

when said electricity is switched ON and said second switching means is actuated thereby said motor means runs in a counter-clockwise rotation, said motor means runs continuously in said counter-clockwise rotation until said first switching means is actuated and thereby said motor means is caused to stop running while said electricity remains ON.

15. The mechanism of claim 11, wherein said motor control means comprises first switching means and second switching means for controlling motor circuit means and thereby for controlling said motor means;

when said electricity is provided and when said first switching means and said second switching means are not actuated thereby said motor means is not operable;

when said electricity is provided and when said first switching means and said second switching means are actuated thereby said motor means is not operable;

when said electricity is provided and when said first switching means is actuated and said second switching means is not actuated thereby said motor means operates continuously in a clockwise direction of rotation;

when said electricity is provided and when said first switching means is not actuated and said second switching means is actuated thereby said motor means operates continuously in a counter-clockwise direction of rotation;

when said electricity is provided and uninterrupted and when said first switching means is actuated thereby said first switching means remains actuated;

when said electricity is provided and uninterrupted and when said second switching means is actuated thereby said second switching means remains actuated;

said first switching means and said second switching means are responsive to said automatic reset menas, when said electricity is interrupted, said first switching means and said second switching means are reset.

16. A mechanism for driving operable means of one or more movable members comprised in an assembly means, wherein said mechanism drives said movable members between position settings, said position settings comprise any two positions selectable within range of motion of said movable members, said mechanism comprising:

drive means for driving engagement with said operable means;

actuating means for establishing said position settings;

motor control means comprising automatic reset means for controlling automatic operation and for resetting said mechanism, said motor control means is responsive to said actuating means;

electric reversible motor means having shaft means, said drive means is affixed to said shaft means and thereby rotatable in either direction around its axis by said motor means, said motor means is responsive to said motor control means;

signal actuated control means having an outlet means and a switching means for switching electricity ON and OFF to said outlet means;

conductor means having plug means for connecting said motor control means to the outlet means of said signal actuated control means.

17. The mechanism of claim 16, wherein saud signal actuated control means comprises first plug means for connecting to a first electric supply means and second plug means for optionally and simultaneously connecting to a clock actuated switch means, said clock actuated switch means is connected to an electric supply means, said clock actuated switch means comprises an outlet means and timer controlled switching means for switching electricity ON and OFF to said outlet means;

wherein electricity is provided to said signal actuated control means by said first electric supply means and optionally and simultaneously switched ON and OFF to said signal actuated control means by said clock actuated switch means, said signal actuated control means further comprises switching means for controlling said electricity to the outlet means of said signal actuated control means, said signal actuated control means further comprises signal receiver means for controlling the switching means of said signal actuated control means;

said signal receiver means is responsive to signals from signal transmitter means, said signal transmitter means is located in a remote location and having actuation means to cause said signals to be transmitted, said signals are transmitted over predetermined distances to where said signal receiver means is located.

18. The mechanism of claim 16, wherein said mechanism further comprises mounting and tension means, said mounting and tension means comprise an attachment means for adjustably affixing to a surface in proximity to said operable means, said mounting and tension means further comprise receiving means;

wherein said mechanism further comprises housing means for said motor control means and said motor means, said housing means comprise connector means, said connector means is adjustably assembled with said receiving means for adjustably joining said housing means with said mounting and tension means and for adjustably engaging said drive means with said operable means, thereby said driving engagement is established, wherein said driving engagement is adjustable for forcible driving engagement for minimizing slippage, wherein said forcible driving engagement is increasable and maintainable and relievable.

19. The mechanism of claim 16, wherein said driving engagement is established thereby said mechanism controls said operable means;

said position settings comprise a first position setting and a second position setting, said actuating means comprise first actuating means and second actuating means;

said actuating means are adjustable for adjustably establishing said position settings, said first actuating means cause actuation of said motor control means when said movable members are located at said first position setting, said second actuating means cause actuation of said motor control means when said movable members are located at said second position setting;

when said electricity is switched OFF thereby said automatic reset means cause said motor control means to reset and thereby said mechanism is ready for said automatic operation, said automatic operation comprises a first operating cycle and a second operating cycle;

said first operating cycle is caused when said electricity is switched ON while said movable members are located at said first position setting, said first operating cycle comprises said first actuating means causing actuation of said motor control means for causing said motor means to operate for driving said movable members to said second position setting, when said movable members are driven to said second position setting thereby said second actuating means causes actuation of said motor control means for causing said motor means to stop operating and thereby terminating said first operating cycle, thereby said movable members remain at said second position setting, when said electricity is subsequently switched OFF thereby said mechanism is ready for said automatic operation and said second operating cycle will occur when said electricity is switched ON;

said second operating cycle is caused when said electricity is switched ON while said movable members are located at said second position setting, said second operating cycle comprises said second actuating means causing actuation of said motor control means for causing said motor means to operate for driving said movable members to said first position setting, when said movable members are driven to said first position setting thereby said first actuating means causes actuation of said motor control means for causing said motor means to stop operating and thereby terminating said second operating cycle, thereby said movable members remain at said first position setting, when said electricity is subsequently switched OFF thereby said mechanism is ready for said automatic operation and said first operating cycle will occur when said electricity is switched ON.

20. The mechanism of claim 16, wherein said motor control means comprise first switching means and second switching means;

said automatic reset means cause said motor control means to reset when said electricity is switched OFF;

when said electricity is switched ON and said first switching means is actuated thereby said motor means runs in a clockwise rotation, said motor means runs continuously in said clockwise rotation until said second switching means is actuated and thereby said motor means is caused to dtop running while said electricity remains ON;

when said electricity is switched ON and said second switching means is actuated thereby said motor means runs in a counter-clockwise rotation, said motor means runs continuously in said counter-clockwise rotation until said first switching means is actuated and thereby said motor means is caused to stop running while said electricity remains ON.

21. The mechanism of claim 16, wherein said motor control means comprise first switching means and second switching means for controlling motor circuit means and thereby for controlling said motor means;

when said electricity is provided and when said first switching means and said second switching means are not actuated thereby said motor means is not operable;

when said electricity is provided and when said first switching means and said second switching means are actuated thereby said motor means is not operable;

when said electricity is provided and when said first switching means is actuated and said second switching means is not actuated thereby said motor means operates continuously in a clockwise direction of rotation;

when said electricity is provided and when said first switching means is not actuated and said second switching means is actuated thereby said motor means operates continuously in a counter-clockwise direction of rotation;

when said electricity is provided and uninterrupted and when said first switching means is actuated thereby said first switching means remains actuated;

when said electricity is provided and uninterrupted and when said second switching means is actuated thereby said second switching means remains actuated;

said first switching means and said second switching means are responsive to said automatic reset means, when said electricity is interrupted, said first switching means and said second switching means are reset.

* * * * *